United States Patent [19]

Citrullo et al.

[11] Patent Number: 4,756,135

[45] Date of Patent: Jul. 12, 1988

[54] WINDOW FRAME ASSEMBLY

[75] Inventors: Joseph Citrullo, 31 Bournemouth Road, Islington, Ontario, Canada, M9A 2C4; Volker Guelck, Waterloo, Canada

[73] Assignee: Joseph Citrullo, Islington, Canada

[21] Appl. No.: 48,242

[22] Filed: May 11, 1987

[51] Int. Cl.[4] ..... E06B 3/14; E06B 3/16

[52] U.S. Cl. ..... 52/656; 52/211

[58] Field of Search ..... 52/204, 211–217, 52/209, 730, 731, 656; 49/501, 504, 404

[56] References Cited

U.S. PATENT DOCUMENTS

| | | | |
|---|---|---|---|
| 1,207,827 | 12/1916 | Winters | 49/504 |
| 1,222,293 | 4/1917 | Iman | 49/504 |
| 1,848,237 | 3/1932 | Baum | 52/215 |
| 2,652,907 | 9/1953 | Miller | 49/504 |
| 2,787,347 | 4/1957 | Henderson | 52/211 |
| 2,916,112 | 12/1959 | Kiehl | 52/211 |
| 3,208,564 | 9/1965 | Sitterly | 52/211 |
| 3,837,119 | 9/1974 | Conneally | 49/404 |
| 3,994,243 | 11/1976 | Anders | 49/505 |
| 4,030,258 | 6/1977 | Anders | 49/505 |
| 4,219,971 | 4/1980 | Mauroner | 49/504 |
| 4,411,111 | 10/1983 | Hosgoka | 52/213 |

*Primary Examiner*—John E. Murtagh

*Attorney, Agent, or Firm*—Fetherstonhaugh & Co.

[57] ABSTRACT

A window assembly comprises a prefabricated sheet metal main frame and a secondary frame suitable for use in supporting window units. A seat is formed in the main frame for seating the secondary frame in the window opening of the main frame. The seat has an entranceway opening laterally from a first side of the frame to permit lateral insertion or lateral removal of the secondary frame into and out of the seat through a first end of the window opening. A first stop is provided at the other side edge of the seat. The stop projects inwardly of the window opening and serves to prevent direct removal of the secondary frame from the seat through the other side of the window opening. A locking device is provided which fits within the other end of the window opening to cooperate with the main frame and the secondary frame to lock the secondary frame in the main frame when it is seated in the seat.

1 Claim, 2 Drawing Sheets

WINDOW FRAME ASSEMBLY

Figure 1:
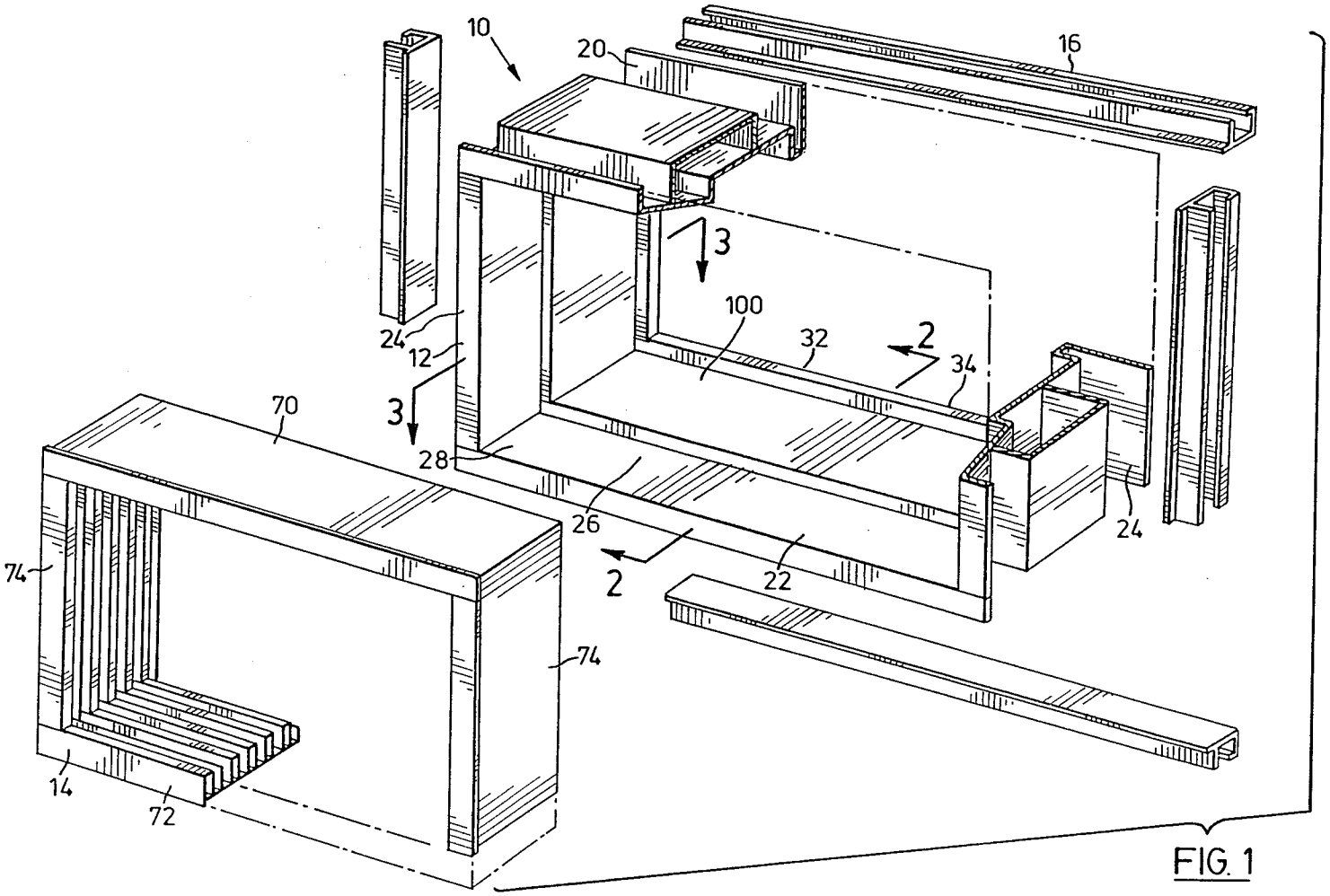

This invention relates to window assemblies. In particular, this invention relates to a window assembly which includes a sheet metal primary frame of a type suitable for use in basement window installations.

A window frame assembly which incooperates a metallic window frame is described in Canadian Pat. No. 818,193 dated July 22, 1969 issued to Operation Rellance Inc. of Downsview, Ontario, Canada. In this patent, the header and sill members are formed to provide spaced parallel recesses in which sash-receiving members are located. The jamb members are of a different cross-sectional profile to the header and sill members and are formed with a longitudinally extending channel in order to add structural rigidity. Individual window units are releaseably mounted in the channel dividing members in a conventional manner.

In order to install the window assembly described in Pat. No. 818,193, the main frame is located in the required position and concrete is poured around the frame so that it becomes an integral part of the wall. The liners are then inserted in the header and the sill and then the window units are mounted in the liners.

The job of installing window units of this type is frequently subcontracted by the builder and considerable difficulty has been experienced in maintaining high quality workmanship in this type of an installation. One of the difficulties which has been experienced is that the window units do not fit in a close fitting sealing relationship within the main frame.

In addition, because the weight of concrete which is poured around a main frame may be quite substantial, it is important to ensure that the main frame has sufficient structural strength to avoid bending under the load of the weight of concrete as this type of bending can also make it very difficult for the windows to fit properly in the main frame in use.

In addition, considerable skill and dexterity is required in order to fit individual window panes into the liners which are provided and if this installation is not carefully carried out, difficulties can be experienced in attempting to open and close the windows in use. In addition, the difficulties associated with the installation of the individual window units can add to the cost of installing the window unit as a whole.

We have found that the difficulties described above with respect to the installation of the window units can be overcome by constructing the window assembly so that it includes a main frame formed from sheet metal and a secondary frame formed from any suitable material such as extracted plastic. The individual window units required for the installation can be mounted in the secondary frame to fit in a close fitting relationship in the factory environment and can be shipped to the job site in the operable position in the secondary frame. The primary frame is formed with a seat which is accessible to the secondary frame through one side of the window opening while a stop is provided on the main frame for preventing removal of the secondary frame through the other side of the window opening.

In order to simplify the structure of the main frame, each of the header, sill and jamb members are formed with an identical profile. In order to rigidify the main frame, each of the header, sill and jamb members is formed from a primary sheet metal member and a secondary sheet metal member. The secondary sheet metal member is mounted on an outer face of the primary sheet metal member and arranged to bridge a wise laterally extending portion of the primary sheet metal member to cooperate therewith in order to form a rigid box section having a section modulus which is substantially greater than that of the primary sheet metal member alone.

According to one aspect of the present invention, there is provided a window assembly comprising a prefabricated sheet metal main frame defining a window opening which has first and second ends at first and second sides of the main frame respectively, a secondary frame suitable for use in supporting window units, said secondary frame being proportioned to fit in said window opening, a seat formed in said main frame for seating said secondary frame in said window opening, said seat having first and second side edges, an entrance opening laterally from said first side edge of said seat to permit lateral insertion or lateral removal of the subframe into or out of the seat through said first end of said window opening, first stop means at said second side edge of said seat, said first stop means projecting inwardly of the window opening to form a stop for preventing direct removal of the secondary frame from the seat through said second end of the window opening, locking means adapted to fit within the second end of the window opening to cooperate with the main frame and the secondary frame to lock the secondary frame in the main frame when it is seated in said seat.

According to a further aspect of the present invention, there is provided in a basement window assembly having header, sill and jamb members cooperating with one another to define a window opening, the improvement wherein each of said members comprises a primary sheet metal member having an inner face directed inwardly of the window opening and an outer face directed outwardly of the window opening and first and second side edges extending longitudinally thereof, said primary sheet metal member being formed to provide a laterally extending window mounting seat on the inner face thereof, said seat being spaced inwardly from each side edge of the primary sheet metal member and a secondary sheet metal member mounted on the outer face of the primary sheet metal member and arranged to bridge a wide laterally extending portion of the primary sheet metal member and cooperate therewith to form a rigid box section having a section modulus which is substantially greater than that of the primary sheet metal member alone.

Figure 2:
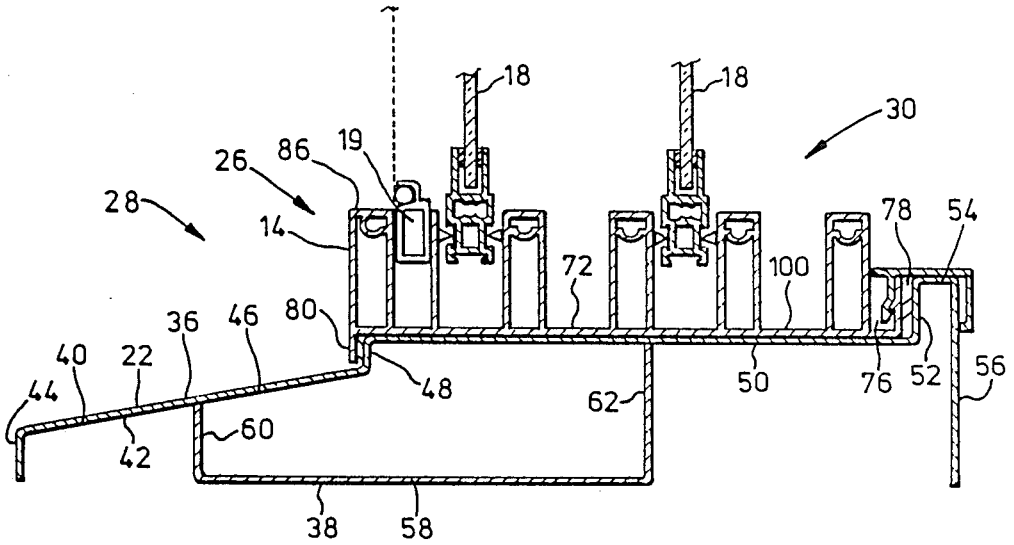
Figure 3:
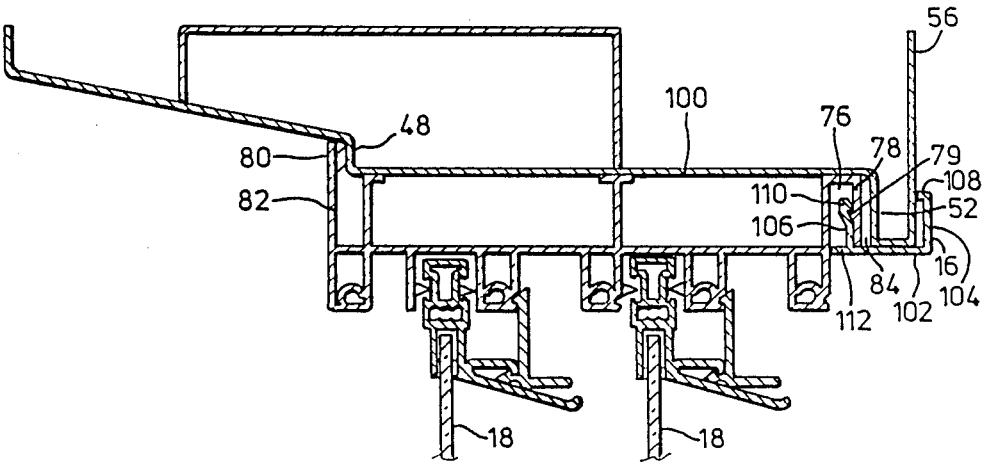

The invention will be more clearly understood after reference to the following detailed specification read in conjunction with the drawings wherein, FIG. 1 is partially sectioned exploded view of a portion of a window assembly constructed in accordance with an embodiment of the present invention, FIG. 2 is a sectional view taken through the main frame member of FIG. 1 in the direction of the arrows 2—2 with the secondary frame and window units mounted therein, FIG. 3 is a sectional view taken through the main frame member of FIG. 1 in the direction of the arrows 3—3 with the secondary frame and window units mounted therein.

With reference to FIG. 1 of the drawings, the reference numeral 10 refers generally to a window assembly constructed in accordance with an embodiment of the present invention prior to assembly thereof and installation of the window units.

The window assembly 10 comprises a main frame 12, a secondary frame 14, locking rails 16 and window units 18 (FIG. 2).

The main frame 12 comprises a header member 20, a sill member 22 and a pair of oppositely disposed jamb members 24.

The header member 20, sill member 22 and jamb members 24 are welded to one another in an end to end relationship so as to define a window opening which is generally identified by the reference numeral 26. The window opening 26 has a first open end 28 at a first side 30 of the main frame and a second open end 32 at a second end 34 of the main frame.

The header, sill and jamb members of the main frame have an identical cross-sectional configuration and consequently, only the sill member 22 will be described with reference to FIG. 2 of the drawings. The sill member 22 comprises a primary sheet metal panel 36 and a secondary sheet metal panel 38.

The primary sheet metal panel has an inner face 40 and an outer face 42.

The primary sheet metal panel is formed to provide a short flange portion 44 at a first side edge thereof. An angularly inclined portion 46 extends from the flange 44 to a portion 48 which extends inwardly of the window opening and which serves to provide a second shoulder for securing the subframe as will be described hereinafter. A generally planar seat forming portion 50 extends from the portion 48 to a second inwardly directed portion 52 to form a first shoulder which acts as a stop for retaining the secondary frame 14 as will be described hereinafter.

A laterally extending portion 54 extends to a flange 56 which projects outwardly and has an outer end which is located in the same plane as the outer end of the flange portion 44.

The secondary sheet metal panel 38 is generally U-shaped and includes a laterally extending wall 58 and a pair of oppositely disposed arms 60,62. The arms 60,62 have their inner ends welded to the outer face of the primary sheet metal panel 36. The laterally extending wall 38 is preferably located in the plane of the outer ends of the flange portions 44 and 56 so as to be spaced a substantial distance from the primary sheet metal member so as to cooperate therewith to form a rigid box section having a section modulus which is substantially greater than that of the primary sheet metal panel alone. This structure adds substantial rigidity to the structure of the primary sheet metal panel and is simple to fabricate. It will be noted that the proportions of the window opening 26 are progressively reduced in a direction from the first open end 28 to the second open end 30 and this serves to permit lateral insertion or removal of the secondary frame to its operable position seated on the seat portion 50 through the first open end 28 of the window opening while preventing lateral insertion or removal of the window unit through the second open end 30.

The secondary frame 14 is prefabricated in a factory environment and includes a header 70, a sill 72 and a pair of oppositely disposed jamb members 74. The header and sill are of an identical profile and the jamb members are of an identical profile which is different from the profile of the header and sill. The header 70, sill 72 and jamb members 74 do have profile features in common and these features will now be described with reference to FIGS. 2 and 3 of the drawings. As shown in FIGS. 2 and 3 of the drawings, a locking channel 76 is formed adjacent the side wall 78 which bears against the first shoulder 52 of the main frame. A lip portion 80 is arranged to bear against the first shoulder 48 of the main frame. Flexible sealing ribs 82 are formed on the lip 80 and are compressible between the lip 80 and the shoulder 48 to form a tight seal therebetween in use. Similarly, flexible ribs 84 are formed on the side wall 78 and are arranged to bear against the first shoulder 52 to form a seal therebetween in use.

The sill member 72 is formed with a plurality of hollow ribs 86 which project inwardly of the window opening and serve to provide a plurality of mounting and slipway channels for receiving an edge of a window unit which is the window unit 18 or a screen frame 19. Various different profiles can be provided in order to accommodate a different number of window units.

The locking rails 16 serve to lock the prefabricated secondary frame in the seat 100 which is formed on the inner face of the seat forming portion 50. Each locking rail 16 is of a uniform cross-section which includes a wall portion 102 which has first and second jaws 104 and 106 projecting outwardly therefrom. The jaw 104 has a lip portion 108 at its inner end and the jaw 106 has a locking notch 110 formed therein. The wall 102 includes a bridge portion 112 which projects beyond the jaw 106.

In use, the locking rail 16 is positioned as shown in FIG. 3 with the jaw 106 extending into the channel 76 and the locking notch 110 engaging the locking detent 79. The jaw 104 is postioned so that the lip 108 bears against the flange 56. The bridge portion 112 extends across the open end of the channel 76 to bear against the secondary frame member.

In use, as previously indicated that main frame is prefabricated and installed by casting concrete around the frame. The secondary frame is prefabricated as previously described and may be shipped to the job site with the window units installed therein in their operable positions. A plurality of locking rails 16 are also shipped with the prefabricated secondary frame. The prefabricated secondary frame, with or without the window units installed therein, can then be positioned on the seat 100 by inserting the prefabricated frame through the first open end 28 of the window frame. The locking rails 16 are then mounted to lock the secondary frame in the main frame as previously described.

From the foregoing, it will be apparent that the present invention provides a window frame assembly which is simple to manufacture and install and which has substantial structural strength.

We claim:

1. In a basement window assembly having header, sill and jamb members cooperating with one another to define a window opening, the improvement wherein each of said members comprises;

(a) a primary sheet metal member having an inner face directed inwardly of the window opening and an outer face directed outwardly of the window opening and first and second side edges extending longitudinally thereof, said primary sheet metal member having a laterally extending wall and a pair oppositely disposed arms projecting outwardly from the laterally extending wall and cooperating therewith to provide a generally U-shaped cross-sectional configuration, said laterally extending wall being formed to provide a laterally extending window mounting seat on the inner face thereof, seat being spaced inwardly from each side edge of the primary and an angularly inclined portion which extends inwardly from the first side edge to said seat; and, (b) a secondary sheet metal member comprising a laterally extending wall having a pair of oppositely disposed arms projecting at right angles from opposite ends thereof to provide a generally U-shaped configuration, said arms each having an outer edge which is welded to the outer face of the primary sheet metal member such that the secondary sheet metal member is integrally connected to and arranged to bridge a wide laterally extending portion of the primary sheet metal member with the laterally extending wall arranged in a spaced relationship with respect to the outer face of the primary sheet metal member and extending in the plane of the outer edge of the arms of the primary sheet metal member so as to be within the confines of the U-shaped configuration of the primary sheet metal member to cooperate therewith to form a rigid box section having a section modulus which is substantially greater than that of the primary sheet metal member alone.

* * * * *